US009566498B2

(12) United States Patent
Holm et al.

(10) Patent No.: US 9,566,498 B2
(45) Date of Patent: Feb. 14, 2017

(54) SKI BINDING FOR TOURING OR CROSS-COUNTRY SKIING

(71) Applicant: ROTTEFELLA AS, Klokkarstua (NO)

(72) Inventors: Thomas Holm, Oslo (NO); Øyvar Svendsen, Oslo (NO); Even Wøllo, Naersnes (NO)

(73) Assignee: ROTTAFELLA AS, Klokkarstua (NO)

( * ) Notice: Subject to any disclaimer, the term of this patent is extended or adjusted under 35 U.S.C. 154(b) by 0 days.

(21) Appl. No.: 15/021,977

(22) PCT Filed: Sep. 17, 2014

(86) PCT No.: PCT/NO2014/050168

§ 371 (c)(1),
(2) Date: Mar. 15, 2016

(87) PCT Pub. No.: WO2015/041540

PCT Pub. Date: Mar. 26, 2015

(65) Prior Publication Data

US 2016/0220889 A1 Aug. 4, 2016

(30) Foreign Application Priority Data

Sep. 20, 2013 (NO) ..... 20131267

(51) Int. Cl.
*A63C 9/20* (2012.01)

(52) U.S. Cl.
CPC ..... *A63C 9/20* (2013.01)

(58) Field of Classification Search
CPC ..... A63C 9/20; A63C 9/10; A63C 9/16; A63C 9/18; A63C 10/10; A63C 10/106; A63C 9/086
See application file for complete search history.

(56) References Cited

U.S. PATENT DOCUMENTS 4,613,150 A * 9/1986 Cooper ..... A63C 9/20 280/615
4,995,632 A * 2/1991 Girault ..... A63C 9/20 280/615

(Continued)

FOREIGN PATENT DOCUMENTS

EP 0131234 A2 1/1985
EP 1702658 A1 9/2006

(Continued)

OTHER PUBLICATIONS

International Search Report, ISA/EP, Rijswijk, NL mailed Feb. 16, 2015.

(Continued)

*Primary Examiner* — Frank Vanaman
(74) *Attorney, Agent, or Firm* — Harness, Dickey & Pierce, PLC

(57) ABSTRACT

A ski binding comprises a first recess for receiving a ski shoe pin, a locking member movable between a locking position and a open position, a biasing means to bias the locking member towards the locking position, and an activation member rotatably attached to the housing for rotation around a transversal rotational axis of the binding. The locking member has at least one outer portion that allows a ski shoe pin to force the locking member from the locking position towards the open position when the ski shoe pin enters the first recess. The activation member has an arm extending radially away from its transversal rotational axis. The activation member and the locking member are operatively connected such that when the arm rotates in the first rotational direction through a predetermined lower operational range, the activation member forces the locking member from the locking position to the open position.

9 Claims, 3 Drawing Sheets

(56) References Cited

U.S. PATENT DOCUMENTS

| | | | | |
|---|---|---|---|---|
| 5,338,053 | A * | 8/1994 | Hauglin | A63C 9/20 280/615 |
| 7,832,754 | B2 | 11/2010 | Girard et al. | |
| 9,126,095 | B2 | 9/2015 | Wollo et al. | |
| 2006/0197312 | A1 | 9/2006 | Girard et al. | |
| 2012/0126510 | A1* | 5/2012 | Yelovina | A63C 9/08571 280/613 |
| 2013/0300088 | A1 | 11/2013 | Wollo et al. | |
| 2013/0313807 | A1 | 11/2013 | Wollo et al. | |
| 2015/0209651 | A1 | 7/2015 | Wollo et al. | |

FOREIGN PATENT DOCUMENTS

| | | | |
|---|---|---|---|
| EP | 2319596 | A2 | 5/2011 |
| FR | 2664174 | A1 | 1/1992 |
| JP | 2003-117047 | A | 4/2003 |
| WO | WO-2012/036561 | A1 | 3/2012 |

OTHER PUBLICATIONS

Written Opinion of the ISA, ISA/EP, Munich, mailed Feb. 16, 2015.

* cited by examiner

SKI BINDING FOR TOURING OR CROSS-COUNTRY SKIING

CROSS-REFERENCE TO RELATED APPLICATIONS

This application is a 371 U.S. National Stage of International Application No. PCT/NO2014/050168, filed Sept. 17, 2014, which claims the benefit of and priority to Norwegian Patent Application No. 20131267, filed Nov. 20, 2013. The entire disclosures of the above applications are incorporated herein by reference.

TECHNICAL FIELD

The present invention relates to an improved ski binding for touring or cross-country skiing. More specifically, the present invention relates to such a binding suitable for use by children.

BACKGROUND

As is well known by any manufacturer of ski bindings, as well as most users of ski bindings, a ski binding should comprise of as few functional parts as possible for flawless function in use when exposed to repetitive stress, snow, ice and water entering and freezing within the binding. Moreover, fewer functional parts allows easier assembly and lower production cost of the binding. To further reduce production cost while simultaneously offering a high quality binding to a customer at an acceptable sale price, is it advantageous to allow most or all of the assembly of the parts of the binding to be performed in a fully automatic process. The fewer manual operations required, the less expensive the binding becomes. Currently there exists a very large amount of ski bindings on the market, and a substantial number of these bindings are based on the well-known NNN norm, i.e. for use with ski shoes that have a transversal engagement pin mounted underneath the front of the sole of the ski shoe, the binding engaging the engagement pin at either end of the engagement pin or parts of the engagement pin. Several of these ski bindings are designed in a way that requires several manual and/or complicated automated operations to assemble the different parts of the binding. In particular, in an automated assembly operation it is disadvantageous to allow binding engagement operations to be performed from different directions, i.e. some operation in a vertical direction, some in a horizontal direction as well as at an angle relative to these directions. Also, rotating a constructional part or element could complicate or add further complexity or cost to the required equipment. Operations in several directions to assemble parts could therefore include joining certain parts either manually or in different positions prior to the in-line part assembly.

A binding solving the aforementioned problems is described in WO2012036561A1.

Although this binding is an excellent binding, children sometimes find it difficult to enter and exit.

One type of known binding provides a front arm for manual opening of the locking mechanism by the child. An example is the Rottefella Touring Manuell. The arm can be rotated upwards to move a wire from a locking position to an open position in which the arm can be left resting due to inherent friction between moving parts of the binding. After opening of the locking mechanism, one can enter the binding and subsequently manually force the arm down to move the wire back to the locking position. This binding has no step-in functionality and is thus better suited for uneven terrain where step-in bindings tend to be difficult to enter.

Another known binding is the Rottefella Touring Auto. This binding provides a step in functionality but has to be opened with a ski pole for exit, and is not easy to step into on uneven terrain.

Thus, an object of the invention is to provide an improved ski binding for children, enabling easy entry and easy exit of a ski shoe in all types of terrain, whilst being easy to assemble. This and other objects are achieved by a ski binding according to a first aspect of the invention.

A binding according to a first aspect of the invention comprises a housing comprising a first recess for receiving a ski shoe pin. The binding also comprises a locking member movable back and forth between a locking position, in which one or more locking portions of the locking member cooperate with the first recess for mutually preventing a ski shoe pin from being removed from the first recess, and an open position, in which the one or more locking portions are retracted from the first recess to allow the ski shoe pin to enter and exit the first recess. Further, the binding comprises a biasing means configured to bias the locking member towards the locking position. The binding also comprises an activation member rotatably attached to the housing for rotation around a transversal rotational axis of the binding. The locking member is provided with at least one outer portion shaped to allow a ski shoe pin to force the locking member from the locking position towards the open position upon entry of the ski shoe pin into the first recess. The activation member is provided with an arm extending radially away from the transversal rotational axis of the activation member. The activation member and the locking member are operatively connected by means of mutually cooperating connection means configured such that at rotation of the arm in the first rotational direction through a predetermined lower operational range of the arm, the activation member forces the locking member from the locking position to the open position. The mutually cooperating connection means are also configured such that any movement of the arm caused by movement of the locking member from the locking position to the open position occurs only within the predetermined lower operational range of the arm. The binding is provided with a means for releasably holding the locking member in its open position at movement of the arm to a predetermined upper position outside the predetermined lower operational range of the arm.

The arm of the activation member enables a child to reach in front of him/her and easily apply a relatively high torque to the activation member to force the locking member open. This binding also features means for holding the locking member in its open position to thereby allow an adult and child to first open the locking mechanism, and subsequently focus on getting the child's ski shoe secured to the binding, thereby avoiding any need to manually apply force to the arm to prevent the biasing means from moving the locking member back to its closing position during entry into the binding. This binding is also provided with a step-in functionality which when the underlying terrain so permits, allows a child to step into the binding without operating the arm. At step-in into the binding, it is important that the locking member can first be forced open by the ski shoe pin, and that the locking member subsequently automatically returns to its locking position. The holding means is configured to engage direct or indirect holding of the locking member first when the arm has been lifted above the predetermined lower operational range of the arm to the predetermined upper position. At step-in into the binding, the movement of the locking member induced by the pin of the ski shoe is limited to movement within the lower operational range. Thus, step-in into the binding can be made without triggering engagement of the holding means.

The binding is thus more suitable for use by a child than prior art bindings, since the child can easily enter and exit the binding independently of the underlying terrain, due to the non-conflicting provision of the following features into the same binding:

- easy manual opening of the locking mechanism by a child,
- step-in functionality, and
- a functionality giving a stable open position of the locking member/binding.

In an embodiment, the means for releasably holding the locking member in its open position comprises a first engagement means provided at the arm, the activation member or the locking member, and a corresponding second engagement means provided somewhere on the binding for releasable engagement of the first and second corresponding engagement means at movement of the arm to the predetermined upper position. The first and second means are thus moved relative to each other at operation of the arm, wherein they engage, for example by friction or magnetism, at movement of the arm to the predetermined upper position.

In an embodiment, the locking member is movable from the locking position, towards the open position and past the open position by movement of the arm. Normal operation of the binding requires movement of the locking member between the locking position and the open position. In this embodiment, the locking member is further movable away from its closed position past its open position. This further forced movement of the locking member enables improved breaking and removal of ice, snow and dirt jamming the binding.

In an embodiment, wherein the mutually cooperating connection means are also configured such that at rotation of the arm within the lower operational range of the arm in a second rotational direction opposite to the first rotational direction, the activation member forces the locking member towards the locking position. Here, since the arm can here be used to force the locking member back towards its locking position, any ice, snow or dirt jamming the binding, can be forced to release. This is particularly advantageous for the present binding since it has a stable open position, such that the binding may be left open for a while. The open binding may then be exposed to sun such that snow in the binding melts and subsequently freezes again, thereby jamming the binding and the locking mechanism in the open position. It should be understood that in other embodiments, the activation member may be configured to engage the locking member differently, such that the arm cannot be used to force the locking member back to its locking position, wherein one instead has to rely on the biasing means for moving the locking member back to its locking position. The biasing means is typically not strong enough to crush ice for releasing a frozen binding. Further choosing a very strong biasing means would make it difficult for a child to open the binding.

An outer end portion of the arm may be provided with a hand grip.

The hand grip provides an increased gripping area for the child to reach and grab when pulling the arm.

The hand grip may be detachable from the arm. Since the hand grip is detachable, the grip can be attached to the arm after the arm has been introduced through a front opening of the cover member. Such design thereby enables a large grip without obstructing automatic assembly operations and without requiring excessively large size of such a front opening.

The detachable hand grip may be provided with left and right protrusions.

The left and right protrusions enables improved grabbing of the arm from the left and right sides of the arm respectively, which in turn enables a child to strongly grip the arm with his/hers fingertips.

The detachable hand grip may be provided with a front protrusion.

The front protrusion enables grabbing of the arm from the front side of the arm and thereby enables a longer arm, such that less force is needed to overcome the force of the biasing means.

The housing may comprise a cover member and a bottom member insertable into the cover member for mutually defining an inner space for housing of the activation member, the biasing means and the locking member, wherein the bottom member is provided with bottom, left and right support surfaces for jointly guiding the locking member within the inner space of the housing for movement along a longitudinal axis of the binding, wherein the activation member engages the locking member by means of a recess in the activation member engaging a protrusion provided at an end portion of the locking member, wherein the biasing means is a resilient member provided along the longitudinal axis of the binding between a seat portion of the housing and a seat portion of the locking member, wherein the bottom member is provided with left and right seats for rotatably supporting the activation member, wherein the left and right seats of the bottom member are positioned such that the transversal axis of the binding is located along the length of the biasing means, and wherein the activation member is provided with a central recess for receiving a portion of the biasing means.

At assembly of the binding, the locking member and biasing means are first positioned on the bottom member. Then, the activation member and its arm are positioned on top of the locking member and biasing means, with the activation member supported in the left and right seats of the bottom member. The central recess allows the activation member to be positioned closer to the bottom support surface of the bottom member without obstructing movement of the biasing means. Since the activating member is positioned along the length of the biasing means, and not in extension of the biasing means, the locking member does not have to be extended past the biasing means to provide for engagement with the activating member. Altogether, this makes it possible to produce a shorter and lower binding mechanism. At the same time, after the locking member, the activation member and the biasing means have been assembled onto the bottom member, all those parts form a unit which is easy to slide into the recess of the cover member of the housing for locking ails parts in place, thereby enabling easy automated assembly of the binding.

TABLE 1

Table of reference numerals

| | |
|---|---|
| 1 | touring or cross-country binding |
| 2 | housing |
| 3 | cover member |
| 4 | bottom member |
| 5 | first recess of cover member |
| 6 | locking member |
| 7 | longitudinal axis of binding |
| 8 | locking portions of locking member |
| 9 | activation member |
| 10 | transversal rotational axis |
| 11 | pins of activation member |
| 12 | seats of bottom member |
| 13 | recess of activation member |
| 14 | protrusion at end portion of locking member |
| 15 | arm of activation member |
| 16 | protrusions at front of activation member |
| 17 | heel of cover member |
| 18 | biasing means |
| 19 | bottom surface |
| 20 | left surface |
| 21 | right surface |
| 22 | snap locking protrusions |
| 23 | central recess of activating member |
| 24 | hand grip |
| 25 | seat portion of housing |
| 26 | seat portion of locking member |
| 27 | outer portions of locking member |
| 28 | resilient element - flexor |
| 29 | predetermined lower operational range |
| 30 | upper portions of housing |
| 31 | recesses of upper portions of housing |

DETAILED DESCRIPTION

A first embodiment of the invention will now be described with reference to the appended drawings. It should be understood that any relative orientations and directions given in the present description, such as forward, downward, upper, etc, are to be interpreted as given for a binding when in use on a ski.

Figure 1:
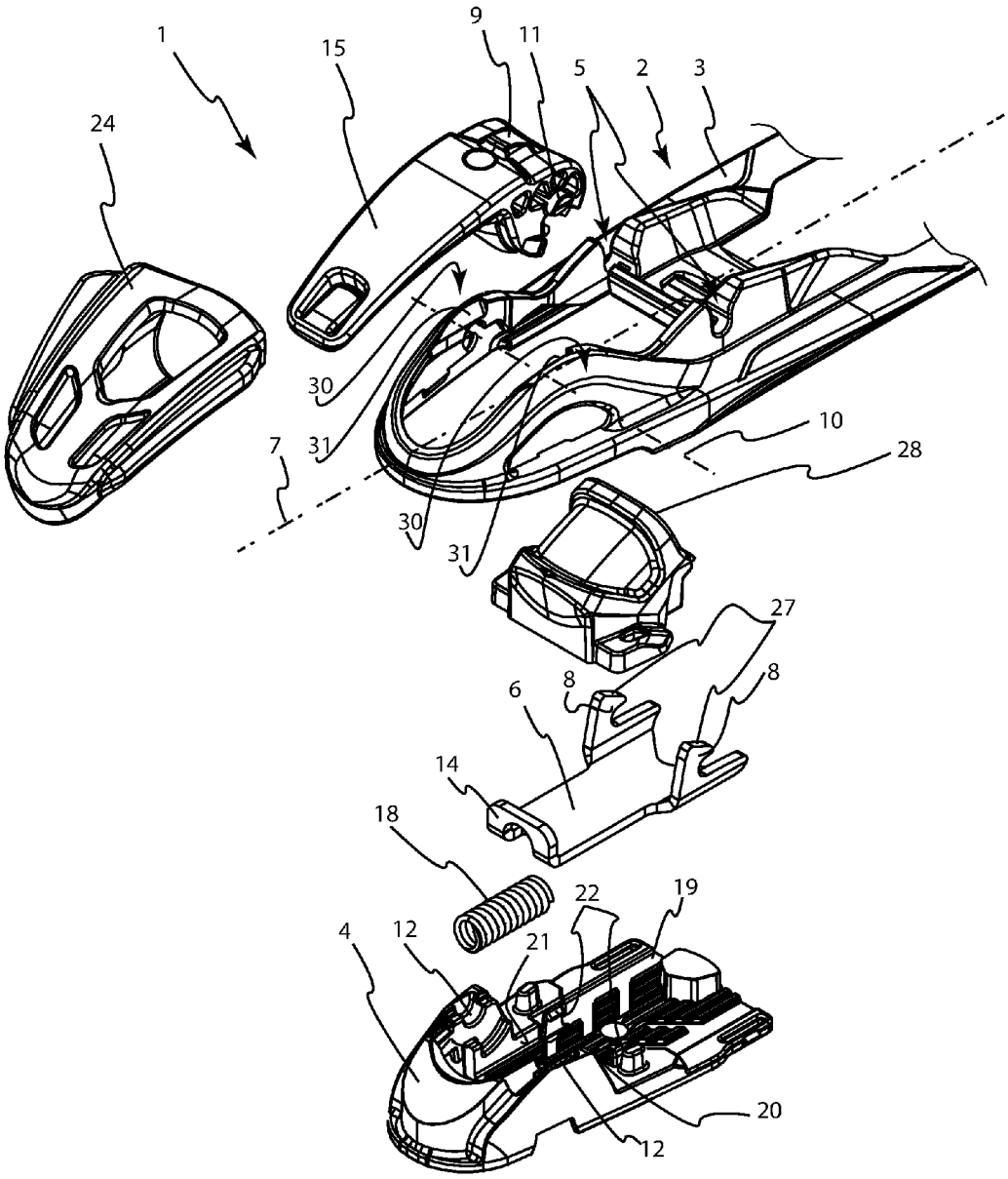
FIG. 1 shows a cut off exploded perspective view of a binding according to a first embodiment of the invention.

As shown in FIG. 1, the touring or cross-country binding 1 according to the first embodiment comprises a housing 2 comprising a cover member 3 and a bottom member 4 insertable into the cover member 3. The cover member 3 is provided with a first recess 5 for receiving a ski shoe pin (not shown) in a transversal direction to the binding 1. The first recess 5 has a rounded bottom support surface for receiving and rotatably supporting the ski shoe pin. Upper portions of the cover member leading down into the first recess are slanted so as to guide the pin into the first recess 5.

Figure 5:
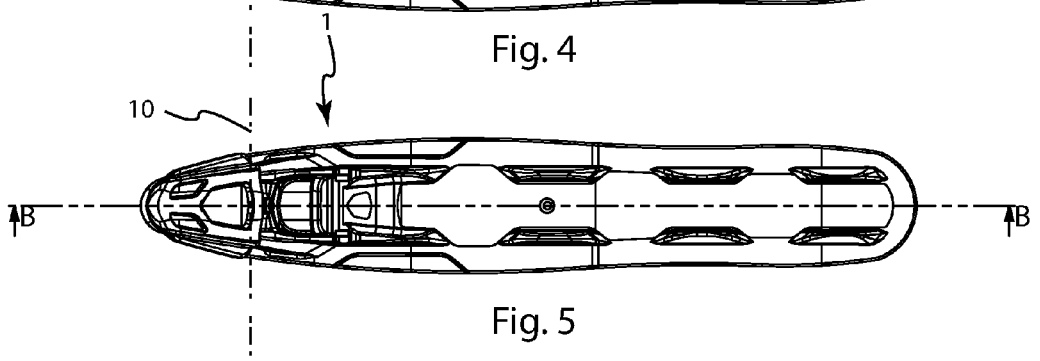
FIG. 5 shows a top view of the binding also shown in FIGS. 1-4, in the release position.
Figure 6:
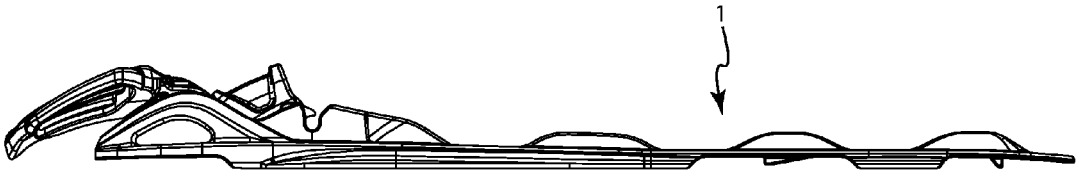
FIG. 6 shows a side view of the binding also shown in FIGS. 1-5, in the locking position.
Figure 7:
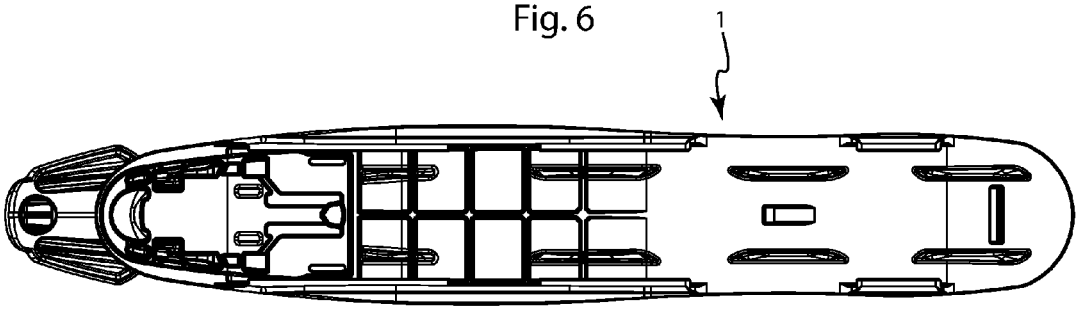
FIG. 7 shows a bottom view of the binding also shown in FIGS. 1-6, in the locking position.
Figure 8:
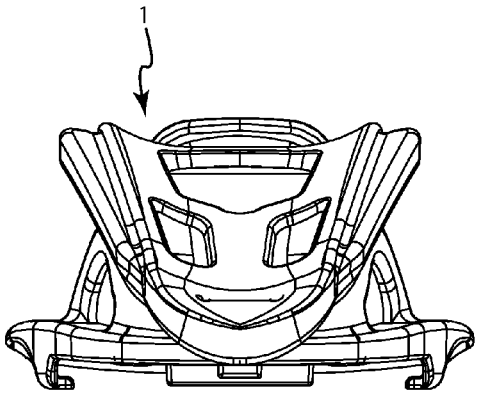
FIG. 8 shows a front view of the binding also shown in FIGS. 1-7.
Figure 9:
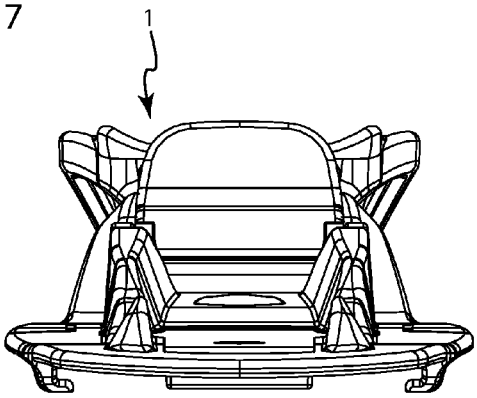
FIG. 9 shows a back view of the binding also shown in FIGS. 1-8.

The binding 1 also comprises a locking member 6 made from stainless steel, thus being strong enough to resist wear and tear, ice and snow, and stress from skiing accidents. The locking member 6 is slidably movable back and forth along a longitudinal axis 7 (see FIGS. 2 and 5) of the binding 1 between a locking position (see FIG. 3), in which one or more locking portions 8 of the locking member 6 cooperate with the first recess 5 for mutually preventing the ski shoe pin from being removed from the first recess 5, and a open position, in which the one or more locking portions 8 are retracted from the first recess 5 for allowing the ski shoe pin to enter and exit the first recess 5. In other embodiments the locking member may be rotatable and/or slidable.

The binding 1 also comprises an activation member 9 rotatably attached to the housing 2 for rotation around a transversal rotational axis 10 of the binding 1. The activation member 9 is rotatably supported by means of left and right pins 11 extending on left and right sides of the activation member respectively along the rotational axis 10. The pins 11 are supported in corresponding left and right (lower) seats 12 of the bottom member 4 and held in place in the seats 12 of the bottom member 4 by corresponding left and right (upper) seats of the cover member 3. In this embodiment, the activation member is made of plastic with the pins integrally formed. However, the pins 11 are in some embodiments (not shown) replaced by a solid axis extending through the activation member 9. In some embodiments (not shown), the activation member 9 is shaped to be supported directly in the seats 12 of the bottom member and cover member without an intermediate axis or pins, by making an inner diameter of the seats larger, or by providing a fulcrum design giving a similar functionality. In some embodiments, the pins are replaced by recesses in the activation member 9 and corresponding protrusions or pins extending from the bottom member or from the cover member.

The activation member 9 is provided with an arm 15 extending radially away from the transversal rotational axis 10 of the activation member for rotation of the activation member by operation of the arm by hand. The arm is integrally formed with the activation member 9, although the arm 15 in some embodiments (not shown) is provided in the form of a separate member attachable to the activation member 9. The arm of the activation member enables a child to reach in front of him/her and easily apply a relatively high torque to the activation member to force the locking member open. The activation member 9 and the locking member 6 are operatively connected by means of mutually cooperating connection means in the form of a recess 13 in the activation member and a protrusion of the locking member 6 (see FIG. 2) said connection means being configured to cooperate such that at rotation of the arm 15 in the a rotational direction D1 through a predetermined lower operational range 29 of the arm 15, the activation member 9 forces the locking member 6 from the locking position to the open position by means of a heel formed in the activation member by the recess. In some embodiments (not shown), the activation member and the locking member are engaged by means of a protrusion provided on the activation member 9 configured to cooperate with a matching recess or protrusion of the locking member 6. Alternatively, the activation member 9 and the locking member 6 may be engaged by gear tooth on the activation member 9 meshing into one or more corresponding recesses or protrusions of the locking member 6. In some embodiments (not shown), an intermediate member may be provided for operatively connecting the activation member 9 and the locking member 6. In yet some embodiments (not shown), the mutually cooperating connection means may comprise an axis extending through a respective round hole in the other member, similar to a hinge. In yet some embodiments, the mutually cooperating connection means may comprise an axis on one of the members slidably engaging an elongate recess in the other member configured such that a certain slack is built into the operational cooperation between activation member 9 and locking member 6. Slack between the activation member 9 and the locking member 6 may be used to enable moving of the locking member from the locking position to the open position whilst causing only limited movement, or no movement at all, of the activation member in the first rotational direction D1. The arm then has to be rotated a certain first distance before the activation member 9 engages the locking member to force it from the locking position to the open position.

In the first embodiment, shown in FIGS. 1-9, the mutually cooperating connection means are also configured such that at rotation of the arm 15 within the lower operational range 29 of the arm 15 in a second rotational direction D2 opposite to the first rotational direction, the activation member 9 forces the locking member 6 towards the locking position. The direct force applied by hand is much greater than the force applied by the biasing means, such that jamming of the binding in an open or semi-open position is prevented.

In the first embodiment, the locking member 6 moves forward to retract the locking portions out of the first recess 5, and backwards to move locking portions into the first recess 5. In some embodiments, the locking portions 8 could be pointing forwards, such that the locking member 6 is instead moved backwards to release the ski shoe pin, and vice versa. Of course, the activation member 9 and the locking member have to be redesigned accordingly, such that lifting of the arm 15 from the forward position through the lower operational range 29 still moves the locking member 6 to its open position. This can for example be achieved by providing the mutually cooperating connection means at an upper portion of the activation member, above its transversal rotational axis 10.

The locking member is made from stainless steel, and the cover member, the bottom member and the activation member with its arm, are all made of injection molded plastic, such as POM. However, it should be understood that other suitable materials may be used within the scope of the invention.

In the first embodiment of the binding, the biasing means 18 is a coil spring provided between a seat portion 25 of the housing and a seat portion 26 of the locking member for biasing of the locking member 6 towards the locking position. In some embodiments, the coil spring could be replaced by some other resilient element configured to be compressed or extended in response to movement of the locking member, the activation member and/or the arm. In some embodiments, an elastic member 28, in the art often called a 'flexor', is provided for abutting a front portion of the ski shoe for deformation of the flexor when the skier rotates the ski shoe forward at lifting of his/hers heel from the ski during skiing. The flexor may complement or replace the biasing means for directly or indirectly biasing the locking member towards its locking position by acting on the locking member 6 or the activation member 9.

Figure 2:
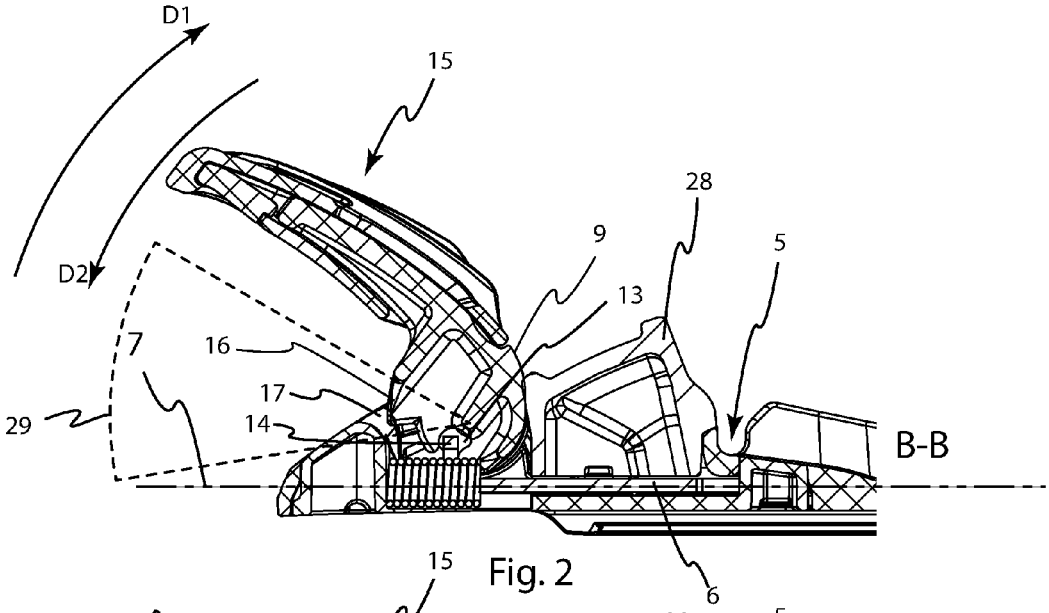
FIG. 2 shows a cut off view in cross section B-B of the binding also shown in FIG. 1, in a release position.
Figure 3:
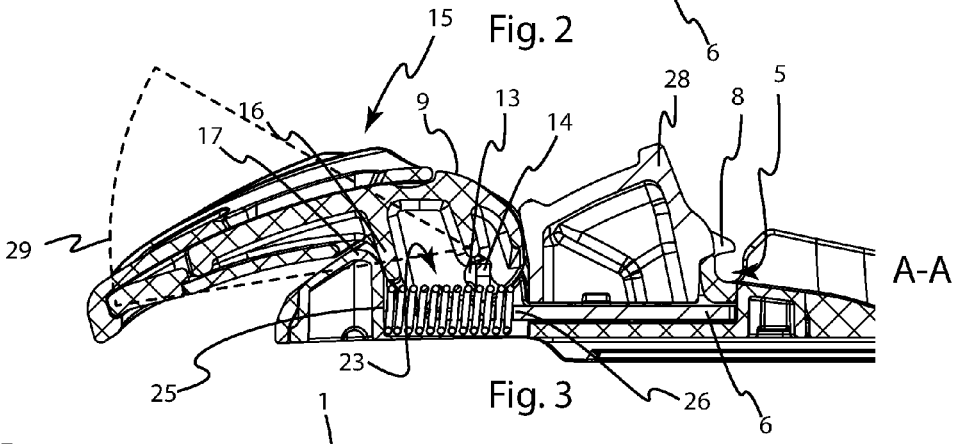
FIG. 3 shows a cut off view in cross section A-A of the binding also shown in FIGS. 1-2, in a locking position.
Figure 4:
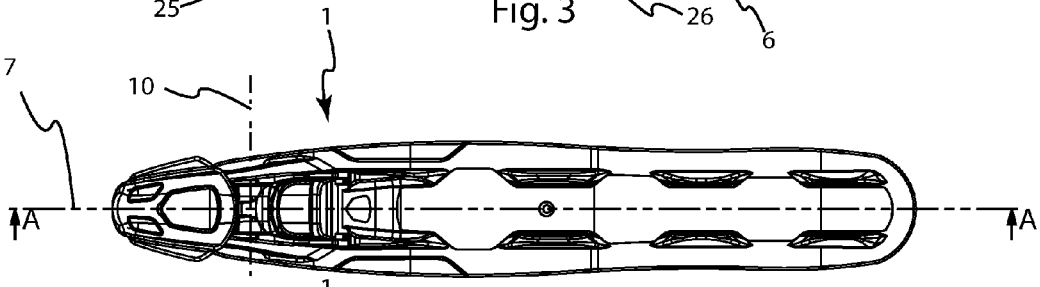
FIG. 4 shows a top view of the binding also shown in FIGS. 1-3, in the locking position.

The binding 1 is provided with a means for releasably holding the locking member 6 in its open position at movement of the arm 15 to a predetermined upper position, as shown in FIG. 2, outside the predetermined lower operational range 29 of the arm 15. The means for releasably holding the locking member 6 in its open position comprises protrusions 16 provided at a front portion of the activation member 6, and a corresponding heel 17 provided on the cover member 3. The protrusion 16 is biased against the heel 17 and releasably engages the corresponding heel 17 when the arm 15 reaches its open position.

In some embodiments, the means for releasably holding the locking member 6 in its open position comprises a first engagement means provided at the arm, the activation member or the locking member, and a corresponding second engagement means provided somewhere on the binding for releasable engagement of the first and second corresponding engagement means at movement of the arm to the predetermined upper position.

In some embodiments (not shown), the means for releasably holding the locking member in its open position comprises one or more corresponding pairs of friction portions respectively provided at different members of the binding 1 for moving relative to each other at movement of the arm 15. The friction portions are configured such that the friction produced is large enough to overcome the force of the biasing means to keep the arm in its lifted position. For example, the friction portions may be left or right side portions shaped to be squeezed between portions of the bottom member 4 at movement of the locking member 6 from the locking position, towards the open position and past the open position.

In the first embodiment, the cover member 3 and bottom member 4 mutually define an inner space for housing of the activation member 9, the biasing means 18 and the locking member 6. The bottom member and the cover member are provided with snap locking member for locking them together. Further, the bottom member 4 is provided with bottom 19, left 20 and right 21 support surfaces (see FIG. 1) together guiding the locking member within the inner space of the housing 2 for movement along the longitudinal axis 7 of the binding. Further, the bottom member 4 is provided with snap locking protrusions 22 configured to snap lock around the locking member when it is placed in the bottom member at assembly of the binding, for preventing the locking member 6 from moving away from the bottom surface 19 whilst allowing the locking member to slide as previously described. The snap locking member thus keeps the parts from falling apart at assembly of the binding and therefore enables easier automation of the assembly process.

Further, the activation member 9 is provided with a central recess 23 for receiving a portion of the biasing means 18. The central recess allows the activation member 9 to be positioned closer to the bottom support surface 19 of the bottom member 4 without obstructing movement of the biasing means 18. Since the activating member 9 is positioned along the length of the biasing means 18, and not in extension of the biasing means 18, the locking member 6 does not have to be extended past the biasing means 18 to provide for engagement with the activating member 9, thereby giving a more compact design.

An end portion of the arm 15 is provided with a detachable hand grip 24, attached by snap locking engagement between the arm 15 and the hand grip. The hand grip 24 is provided with left, right and front protrusions enabling a child to strongly grip the arm 15 with his/hers fingertips. In some embodiments, the hand grip 24 is integrally formed with the arm.

The locking member 6 is provided with at least one outer portion 27 shaped to allow a ski shoe pin to force the locking member 6 from the locking position towards the open position at entry of the ski shoe pin into the first recess 5. The outer portions 27 are provided on the two locking portions 8 of the locking member 6. In some embodiments, the outer portions 27 may be provided on other portions of the locking member for abutting the ski shoe pin at movement of the pin into the first recess 5.

Upper portions 30 of the housing 2 are outwards flexible away from each other along the transversal axis and provided with recesses leading into the seats 12 for supporting the pins 11 (see FIG. 1). The flexibility of the upper portions 30 of the housing 2 combined with the recesses, provide for simple mounting of the activation member 9 at assembly of the binding 1, by simply forcing the activation member 9 towards its intended operational position with its pins 11 positioned along the transversal axis 10, since the upper portions 30 flex outwards when the pins 11 pass, where after they 30 flex back to lock the pins 11 in place between the bottom member 4 and the cover member 3.

The invention claimed is:

1. A touring or cross-country ski binding comprising:

a housing comprising a first recess for receiving a ski shoe pin, a locking member movable between a locking position, in which one or more locking portions of the locking member cooperate with the first recess for mutually preventing a ski shoe pin from being removed from the first recess, and an open position, in which the one or more locking portions are retracted from the first recess for allowing the ski shoe pin to enter and exit the first recess, a biasing means configured to bias the locking member towards the locking position, and an activation member rotatably attached to the housing for rotation around a transverse rotational axis of the binding, wherein the activation member and the locking member are operatively connected, and wherein the locking member is provided with at least one outer portion shaped to allow a ski shoe pin to force the locking member from the locking position towards the open position at entry of the ski shoe pin into the first recess, wherein the activation member is provided with an arm extending radially away from the transverse rotational axis of the activation member, wherein the activation member and the locking member are operatively connected by means of mutually cooperating connection means configured such that at rotation of the arm in a first rotational direction through a predetermined lower operational range of the arm, the activation member forces the locking member from the locking position to the open position, wherein the mutually cooperating connection means are also configured such that any movement of the arm caused by movement of the locking member from the locking position to the open position occurs only within the predetermined lower operational range of the arm, and wherein the binding is provided with a means for releasably holding the locking member in its open position at movement of the arm to a predetermined upper position outside the predetermined lower operational range of the arm.

2. The binding according to claim 1, wherein the means for releasably holding the locking member in its open position comprises a first engagement means provided on the arm, the activation member or the locking member, and a corresponding second engagement means provided on a cover member for releasable engagement of the first and second corresponding engagement means at movement of the arm to the predetermined upper position.

3. The binding according to claim 1, wherein the locking member is movable from the locking position, towards the open position and past the open position by movement of the arm.

4. The binding according to claim 1, wherein the mutually cooperating connection means are also configured such that at rotation of the arm within the lower operational range of the arm in a second rotational direction opposite to the first rotational direction, the activation member forces the locking member towards the locking position.

5. The binding according to claim 1, wherein an outer end portion of the arm is provided with a hand grip.

6. The binding according to claim 5, wherein the hand grip is detachable from the arm.

7. The binding according to claim 6, wherein the hand grip is provided with left and right protrusions.

8. The binding according to claim 6, wherein the detachable hand grip is provided with a front protrusion.

9. The binding according to claim 1, wherein the housing comprises a cover member and a bottom member insertable into the cover member for mutually defining an inner space for housing of the activation member, the biasing means and the locking member, wherein the bottom member is provided with bottom, left and right support surfaces together guiding the locking member within the inner space of the housing for movement along a longitudinal axis of the binding, wherein the activation member engages the locking member by means of a recess in the activation member engaging a protrusion provided at an end portion of the locking member, wherein the biasing means is a resilient member provided along the longitudinal axis of the binding between a seat portion of the housing and a seat portion of the locking member, wherein the bottom member is provided with left and right seats for rotatably supporting the activation member, wherein the left and right seats of the bottom member are positioned such that the transverse axis of the binding is located along the length of the biasing means, and wherein the activation member is provided with a central recess for receiving a portion of the biasing means.

* * * * *